US010414536B2

(12) United States Patent
Cruz

(10) Patent No.: US 10,414,536 B2
(45) **Date of Patent: *Sep. 17, 2019**

(54) PORTABLE DISPLAY CONTAINERS AND METHODS OF MAKING AND USING THE SAME

(71) Applicant: Criss K. Cruz, Clovis, CA (US)

(72) Inventor: Criss K. Cruz, Clovis, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/139,903

(22) Filed: Sep. 24, 2018

(65) Prior Publication Data

US 2019/0023445 A1 Jan. 24, 2019

Related U.S. Application Data

(63) Continuation of application No. 15/670,343, filed on Aug. 7, 2017, now Pat. No. 10,081,451, which is a (Continued)

(51) Int. Cl.

| | |
|---|---|
| ***B65D 5/48*** | (2006.01) |
| ***B65D 5/32*** | (2006.01) |
| ***B65D 71/00*** | (2006.01) |
| ***B65D 5/49*** | (2006.01) |
| *B65D 25/02* | (2006.01) |
| *B65D 25/04* | (2006.01) |

(Continued)

(52) U.S. Cl.

CPC ..... *B65D 5/32* (2013.01); *B65D 5/48038* (2013.01); *B65D 71/0096* (2013.01); *B31B 50/00* (2017.08); *B31B 50/60* (2017.08); *B31B 2120/25* (2017.08); *B65D 5/0035* (2013.01); *B65D 5/48024* (2013.01); *B65D 25/02* (2013.01); *B65D 25/04* (2013.01); *B65D 2571/00814* (2013.01); *B65D 2577/048* (2013.01)

(58) Field of Classification Search

CPC ..... B65D 25/04; B65D 25/02; B65D 5/32; B65D 5/0035; B65D 5/48024; B65D 5/48038; B65D 71/0096; B65D 2577/048; B65D 2571/00814; B31B 11/00; B31B 50/00; B31B 50/60; B31B 2120/25

USPC .... 229/120, 120.02, 120.36, 120.31, 120.29, 229/915, 120.25, 120.26, 120.33, 120.38; 493/90, 91, 162; 220/528, 533, 552, 529, 220/507; 206/386

See application file for complete search history.

(56) References Cited

U.S. PATENT DOCUMENTS

| | | |
|---|---|---|
| 2,647,679 A | 8/1953 | Schilling et al. |
| 2,706,935 A | 4/1955 | Pasjack |

(Continued)

FOREIGN PATENT DOCUMENTS

| | | |
|---|---|---|
| FR | 2800711 A1 | 5/2001 |

*Primary Examiner* — Fenn C Mathew
*Assistant Examiner* — Elizabeth J Volz
(74) *Attorney, Agent, or Firm* — Sherrie Flynn; Coleman & Horowitt LLP

(57) ABSTRACT

Portable display containers with spine and cross supports, methods of making portable display containers with spine and cross supports, and methods of using containers with spine and cross supports. The portable display containers have a plurality of tiers, each tier having a base tray, at least one spine, and two or more cross supports that add strength and rigidity to the display, allowing the portable display containers to be fully loaded with product or items prior to transportation and/or shipment to the display location.

20 Claims, 7 Drawing Sheets

Related U.S. Application Data continuation of application No. 14/256,878, filed on Apr. 18, 2014, now Pat. No. 9,725,205.

(51) Int. Cl.

| | |
|---|---|
| *B65D 5/00* | (2006.01) |
| *B31B 50/60* | (2017.01) |
| *B31B 50/00* | (2017.01) |
| *B31B 120/25* | (2017.01) |

(56) References Cited

U.S. PATENT DOCUMENTS

| | | | | |
|---|---|---|---|---|
| 3,039,667 | A | 6/1962 | Kozlik | |
| 3,826,357 | A | 7/1974 | Roth | |
| 5,251,753 | A | 10/1993 | Piggott et al. | |
| 5,945,147 | A | 8/1999 | Borchard | |
| 6,129,211 | A | 10/2000 | Prakken et al. | |
| 7,621,439 | B2 | 11/2009 | McClure | |
| 9,725,205 | B2 * | 8/2017 | Cruz | B65D 71/0096 |
| 10,081,451 | B2 * | 9/2018 | Cruz | B65D 71/0096 |

* cited by examiner

PORTABLE DISPLAY CONTAINERS AND METHODS OF MAKING AND USING THE SAME

CROSS-REFERENCE TO RELATED APPLICATION

This application claims priority to and is a continuation of U.S. patent application Ser. No. 15/670,343 filed Aug. 7, 2017 (U.S. Pat. No. 10,081,451 to be issued Sep. 25, 2018), which is a continuation of U.S. patent application Ser. No. 14/256,878, filed on Apr. 18, 2014 (U.S. Pat. No. 9,725,205, issued Aug. 8, 2017), which are hereby incorporated by reference in their entireties.

FIELD OF THE INVENTION

The present invention generally relates to the field of display containers and methods of making and using the same. More specifically, embodiments of the present invention pertain to portable display containers having multiple tiers, and spine and cross supports that allow for easy access to the product, yet add strength and rigidity, allowing the portable display containers to be fully loaded with items prior to transportation and/or shipment to the display location. Embodiments of the present invention also relate to methods of making and using portable display containers.

DISCUSSION OF THE BACKGROUND

Most products (e.g., packages of tortillas), after arriving at stores, must be loaded onto store shelving for display to potential consumers, thereby adding significant additional handling costs to the product and exposing the product to damage. Traditional display containers, which may be more effective than store shelving to showcase a product (e.g., because the display container may be more open or eye-catching, the product may be more readily accessed from 3 or 4 sides, the display container may be placed in a prime location in a store apart from the standard store shelving, etc.) are also typically loaded with product after the display container and the product arrive (separately) at the store. This is because such display containers are either heavy and semi-permanent (e.g., those made of steel or aluminum), rendering them inefficient and costly to dispose of after a single use or return to the product vendor for reloading and reuse, or disposable (e.g., those made of cardboard) but lacking the strength and rigidity to protect the product during transportation and/or shipment. Thus, these traditional disposable displays must also be manually loaded with product after the display container arrives at the store.

Consequently, the need exists for containers that are effective for product display (i.e., open with easy access to the product) and are strong and rigid enough to protect the product during shipment and/or transportation to the display location, yet are cost effective and environmentally friendly (e.g., recyclable) as a disposable unit after use, without the traditional need for additional handling to load the product into the display container after arrival at the display destination. Likewise, there is a need for methods of efficiently making and using such display containers.

This "Background" section is provided for background information only. The statements in this "Background" are not an admission that the subject matter disclosed in this "Background" section constitutes prior art to the present disclosure, and no part of this "Background" section may be used as an admission that any part of this application, including this "Background" section, constitutes prior art to the present disclosure.

SUMMARY OF THE INVENTION

The present invention relates to portable display containers (see, e.g. display container 100 in FIG. 1) having a plurality of display tiers or levels (see, e.g., display tiers 101 in FIG. 1) that may be stacked vertically on a portable platform (e.g., a pallet), and are strong enough to be shipped fully loaded with product, but cost effective and environmentally friendly as a disposable unit. Each of the tiers of the portable display containers comprises a base tray (see, e.g., 202 in FIGS. 2 and 302 in FIG. 3A), at least one spine (see, e.g., 203 in FIGS. 2 and 303 in FIG. 3B), and two or more ribs (see, e.g., 204 in FIGS. 2 and 304 in FIG. 3C). The base tray, spine(s) and ribs are configured to provide extra strength and rigidity to the display, thereby allowing the plurality of tiers to be stacked, and each tier of the display container to be loaded with product prior to transportation and/or shipment to the product's display destination.

The present invention further provides methods of making and using portable display containers that may be fully loaded with product prior to shipment and/or transportation (e.g., display container 100 in FIG. 1). The method of making the container generally includes (i) assembling a display tier by (a) forming a base tray, the base tray being formed by folding each of two end panels at an angle of approximately 90° with respect to a bottom panel of a blank for a base tray, folding each end panel extension of two pairs of end panel extensions at an angle of about 90° with respect to the end panel to which the end panel extension is attached, folding each side panel of two side panels at an angle of approximately 90° relative to the bottom panel; and attaching each of the end panel extension to one of the two side panels; (b) forming at least one spine by folding each of two spine flaps at an angle of about 90° relative to spine center portions of a spine blank to form a spine panel, two or more spine slots and a spine top ridge, and folding each spine extension of two pairs of spine extensions at an angle of approximately 90° relative to the spine panel; (c) placing at least one spine into the base tray such that the two pairs of spine extensions contact and/or are attached to the end panels of the base tray; (d) forming at least two cross supports by folding each cross support flap of two cross support flaps at an angle of approximately 90° relative to a cross support center portion of a cross support blank to align cross support cutouts and to form a cross support panel and a cross support top ridge, and folding each cross support extension of two pairs of cross support extensions at an angle of approximately 90° relative to the cross support panel; (e) inserting into and/or mating each of the cross supports with one of the spine slots of the spine(s); (ii) placing the display tier on a portable platform or on a lower tier of the stack of display tiers; and (iii) repeating steps (i) and (ii) for each tier of the portable display container.

In some embodiments, the method further includes applying an adhesive to each of the spine extensions prior to placing the spine(s) into the base tray and/or applying adhesive to each of the cross support extensions prior to inserting into and/or mating the cross support extensions with the spine(s). The base tray, spine(s) and the cross supports provide the extra strength and rigidity necessary to transport the portable display container fully loaded with product.

These and other advantages of the present invention will become readily apparent from the detailed description of various embodiments below.

DETAILED DESCRIPTION

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures and components have not been described in detail so as not to unnecessarily obscure aspects of the present invention.

For the sake of convenience and simplicity, the terms "container," "display," "container display" and "pallet display" are generally used interchangeably herein and the use of one generally includes the others, unless the context necessarily indicates otherwise, but are generally given their art-recognized meanings. Likewise, the terms "cross support" and "rib" are generally used interchangeably, unless the context indicates otherwise.

Additionally, and although at times the present invention is described with regard to the shipment, transportation and/or display of tortillas, the invention is not so limited and may include any product or item that may be loaded on or into the tiers of the portable display container.

Exemplary Portable Display Containers

Figure 1:
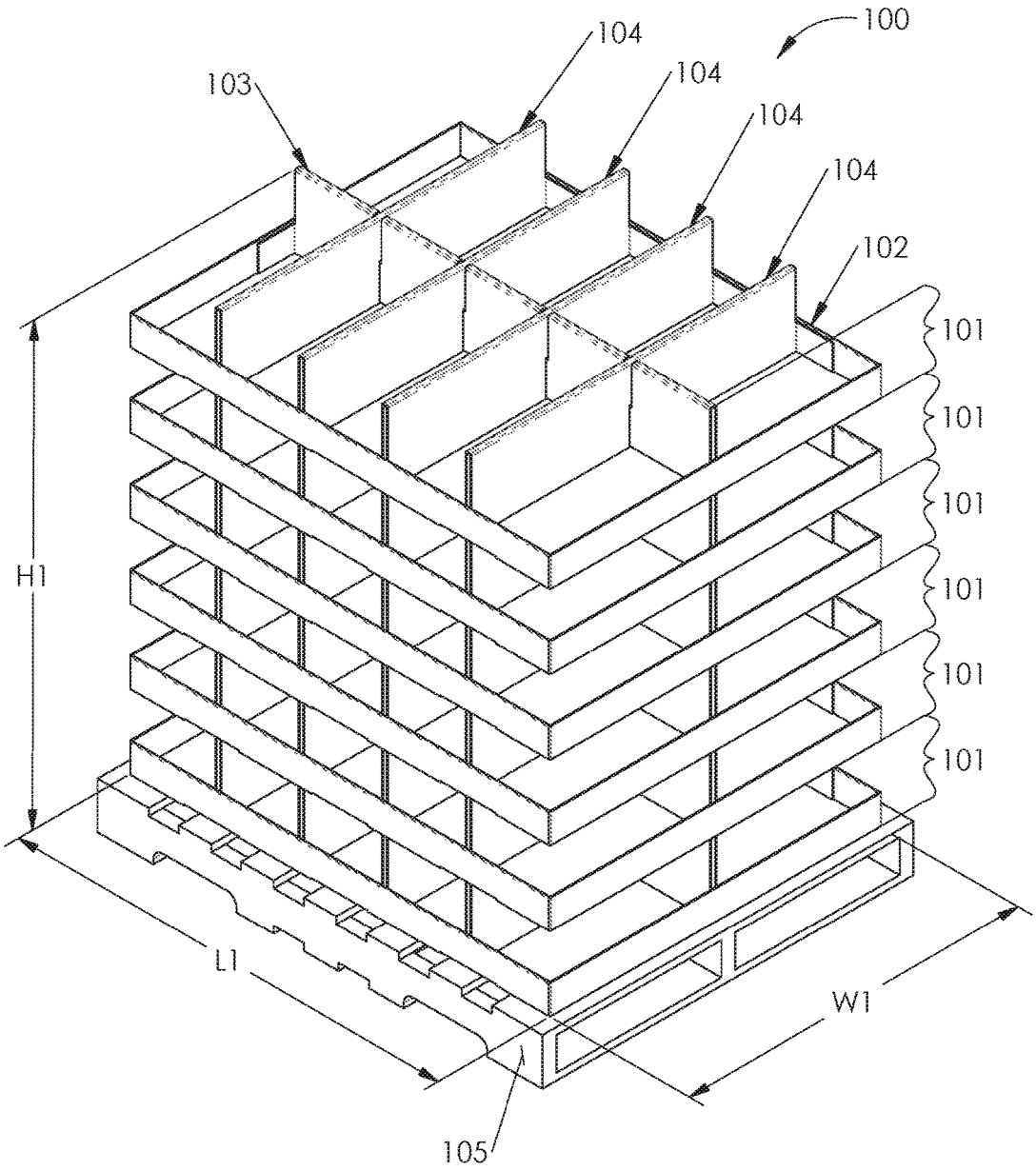
FIG. 1 is a perspective view of an exemplary display container with six display tiers according to an embodiment of the present invention.

Referring to the drawings wherein like reference numbers correspond to like or similar parts throughout the several views, and referring particularly to the exemplary embodiments of FIG. 1, embodiments of the present invention relate to portable display containers having a plurality of tiers in a stack on a portable platform. Although the portable display container 100 of FIG. 1 has six tiers 101, the portable display container of the present invention may have from two to ten tiers or more. The portable platform 105 of FIG. 1 comprises a standard pallet. However, any portable platform capable of (i) being easily transported, (ii) supporting the weight of the display tiers and items in the display tiers, and (iii) being cost effectively disposed of and/or recycled may be used.

In addition, the portable display container 100 of FIG. 1 has an approximately rectangular shape when viewed from the top down, having a width W1 and a length L1. However, the portable display container 100 may also have a shape which is square (i.e., L and W are the same), or the portable display container 100 may be oriented such that the length L is approximately parallel to the short dimension of the pallet 105, and the width W is roughly parallel to the long dimension of the pallet 105.

The length L1 and the width W1 of the portable display 100 of FIG. 1 may range from about 18" to 120" (e.g., 18", 20½", 36¾", 42", 48", 66", 72", 84", 104", etc.) and any value therein. Most typically, the length L1 will be approximately 48" and the width W1 will be approximately 40". In some embodiments, two or more stacks of display tiers may be placed on a single portable platform. For example, two 20"×48" stacks of display tiers may be placed on a one 40"×48" pallet. In embodiments of the present invention, the overall height H1 of the portable display container 100 may range from about 24" to about 72" (e.g., 24½", 32", 40¼", 56", etc.), depending on the number of tiers and the type of product displayed. Most typically, the height H1 will be about 52".

In some embodiments, the portable display container 100 is made from single, double and/or triple wall corrugated pads. In other embodiments, portable display container 100 may be made from cardboard, paperboard, chipboard, a honeycomb pad, a laminate (e.g., paperboard or corrugated paper laminated with plastic and/or foil), combinations thereof, etc. In various embodiments, the portable display container may include any display container that would benefit from added strength or rigidity.

Figure 2:
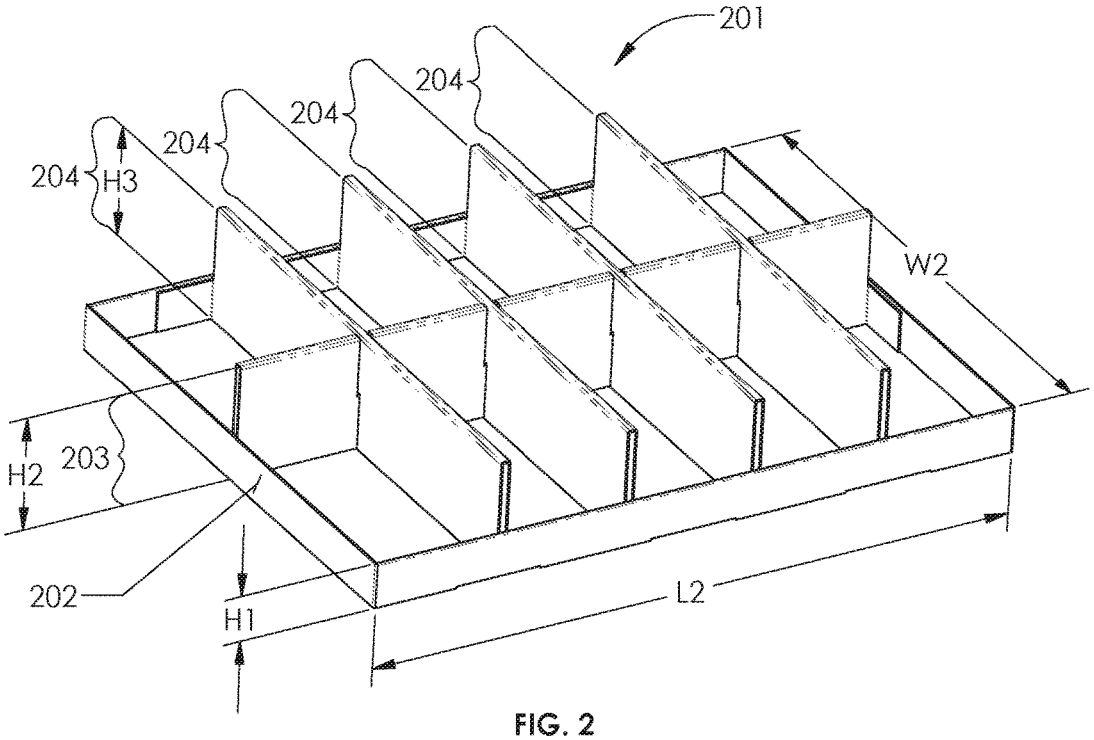
FIG. 2 is a perspective view of an exemplary display tier with a spine centered in the base tray and four cross supports (creating 10 product sections) according to an embodiment of the present invention.

FIG. 2 shows an embodiment of a single tier 201 of the present invention comprising a base tray 202, a spine 203, and four cross supports or ribs 204. As shown in the embodiment of FIG. 2 and most typically, the height H2 of the spine 203 is approximately equal to the height H3 of the cross supports 204. The height H2 of the spine 203 and the height H3 of the cross supports may range from about 6" to about 36" (e.g., 6", 8¾", 10", 17", 20", 24½", 32", etc.). The height H1 of the base tray 202 may range from about 10% to 40% of the height H2 of the spine and/or the height H3 of the cross supports (e.g., 10%, 15%, 18%, 22%, 25%, 33%, 40%, etc.). Dimensionally, the height H1 of base tray 203 may range from about 1" to 9" (e.g., 1", 1¾", 3" 4¼", 6", 7½", etc.). In a typical portable display container that is 48"×40", the height of the base tray will be about 3", and the height of the spine and cross supports will be about 8½".

In the embodiment of FIG. 2, a single spine 203 is approximately centered along the width W of the base tray 202 having approximately the same length L as the base tray. However, in other embodiments, a single tier may comprise two or more spines, and such spines may be located back-to-back, or parallel to each other with a space or gap between each of the spines so as to increase the support and/or the rigidity of the display, with minimal reduction in the usable space of the portable display container. The display tier of FIG. 2 comprises one spine 203 approximately centered in the base tray and four cross supports or ribs 204, each extending the width W of the display tier 201, and configured such that the ribs 204 intersect the spine at roughly a 90° angle. As shown, the embodiment of FIG. 2 creates 10 sections for product to be displayed. Although the embodiment of FIG. 2 comprises four cross supports, in other embodiments the number of cross supports may range from two to eight (e.g., 2, 3, 4, 5, 6, etc.).

Figure 3A:
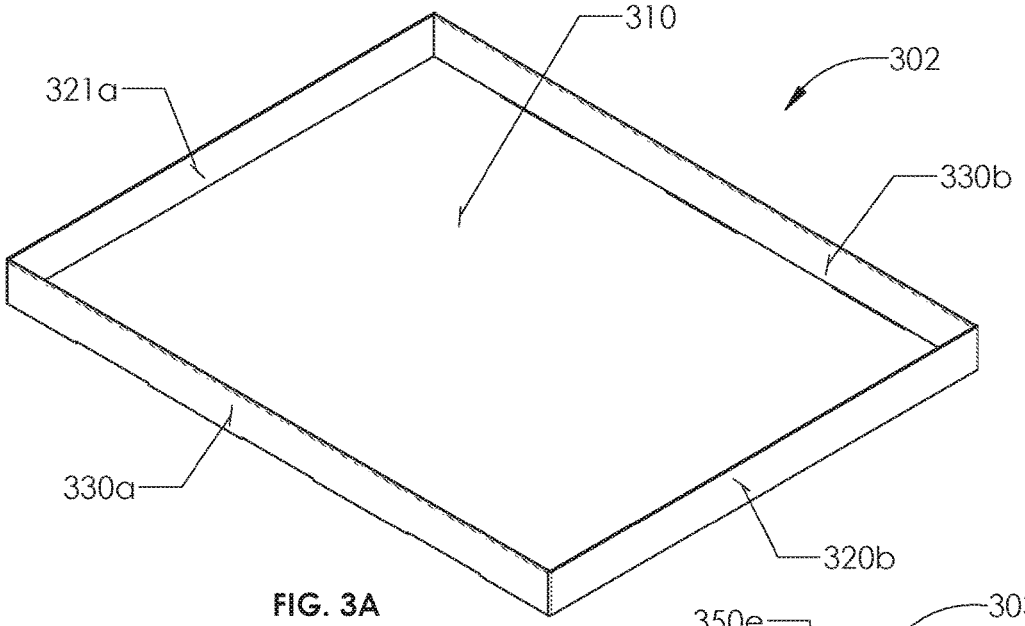
FIG. 3A is a perspective view of an exemplary base tray according to an embodiment of the present invention.
Figure 3B:
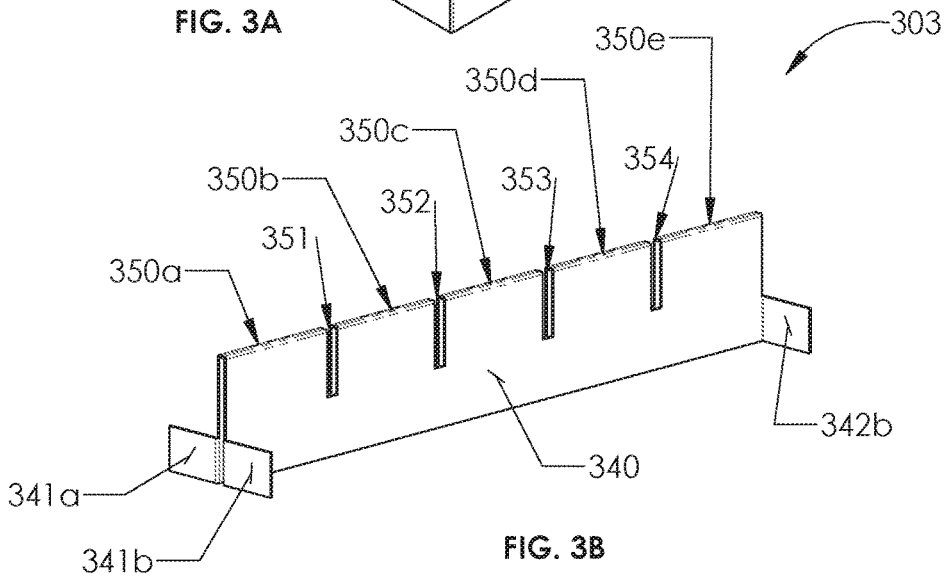
FIG. 3B is a perspective view of an exemplary spine having four spine slots and spine extensions according to an embodiment of the present invention.
Figure 3C:
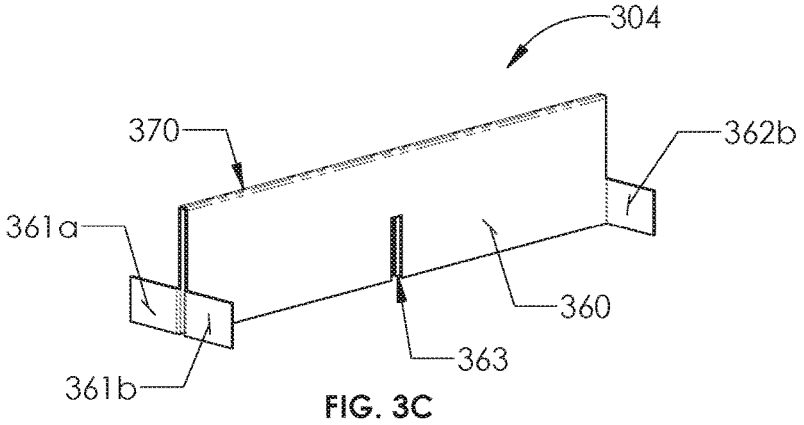
FIG. 3C is a perspective view of an exemplary cross support showing a cross support slot and cross support extensions according to an embodiment of the present invention.

Referring now to FIGS. 3A-3C, therein are shown perspective views of the basic components of the portable display container comprising base tray 302 (see FIG. 3A), a spine 303 (see FIG. 3B) and a cross support 304 (see FIG. 3C). The base tray 302 comprises (i), a bottom panel 310, (ii) two opposing end panels 330*a*, 330*b*, (iii) an exterior side panel 320*b* (the opposing exterior side panel is not shown), and (iv) an interior side flap 321*a* (the opposing interior side flap is not shown). In some embodiments, the base tray may have side panels, not side flaps and the end panels extensions may be glued or otherwise adhered to the side panels. The bottom tray has an approximately rectangular shape when viewed from the top down, and may be constructed of corrugated pads (single, double or triple wall), cardboard, paperboard, chipboard, a honeycomb pad, a laminate (e.g., paperboard or corrugated paper laminated with plastic and/or foil), combinations thereof, etc.

The spine 303 (see FIG. 3B) comprises (i) a spine panel 340, (ii) spine top ridges 350*a*-350*e*, (iii) two pairs of spine extensions 341*a*, 341*b* and 342*a* (not shown), 342*b*, and (iv) four spine slots 351-354. When the spine 303 is placed into and/or assembled with tray 302, the pairs of spine extensions contact and/or engage opposing end panels 330*a*, 330*b* to add stability and/or rigidity to spine 303. In the embodiment of FIG. 3B, each of the four spine cutouts 351-354 are configured to receive one cross support 304 such that, when assembled, a total of four cross supports 304 would be inserted into and/or mated with the spine 303.

The cross support 304 (see FIG. 3C) comprises (i) a cross support panel 360, (ii) cross support top ridge 370, (iii) two pairs of cross support extensions 361*a*, 361*b* and 362*a* (not shown), 362*b*, and (iv) cross support slot 363. When the cross support 304 is inserted into and/or mated with spine 303, the two pairs of cross support extensions 361*a*, 361*b* and 362*a*, 362*b* contact and/or engage interior side flaps 321*a*, 321*b*, respectively, to add stability and/or rigidity to cross support 304. To mate cross support 304 with spine 303, the cross support slot 363 is inserted into and/or through one of the spine slots (e.g., 351) such that the cross support top ridge 370 is even with and/or in the same plane as the spine top ridges 350*a*-350*e*. The same procedure is used to insert cross support 304 into each of the other three spine slots (e.g., 352-354). An assembled tier is more fully described below.

Figure 4:
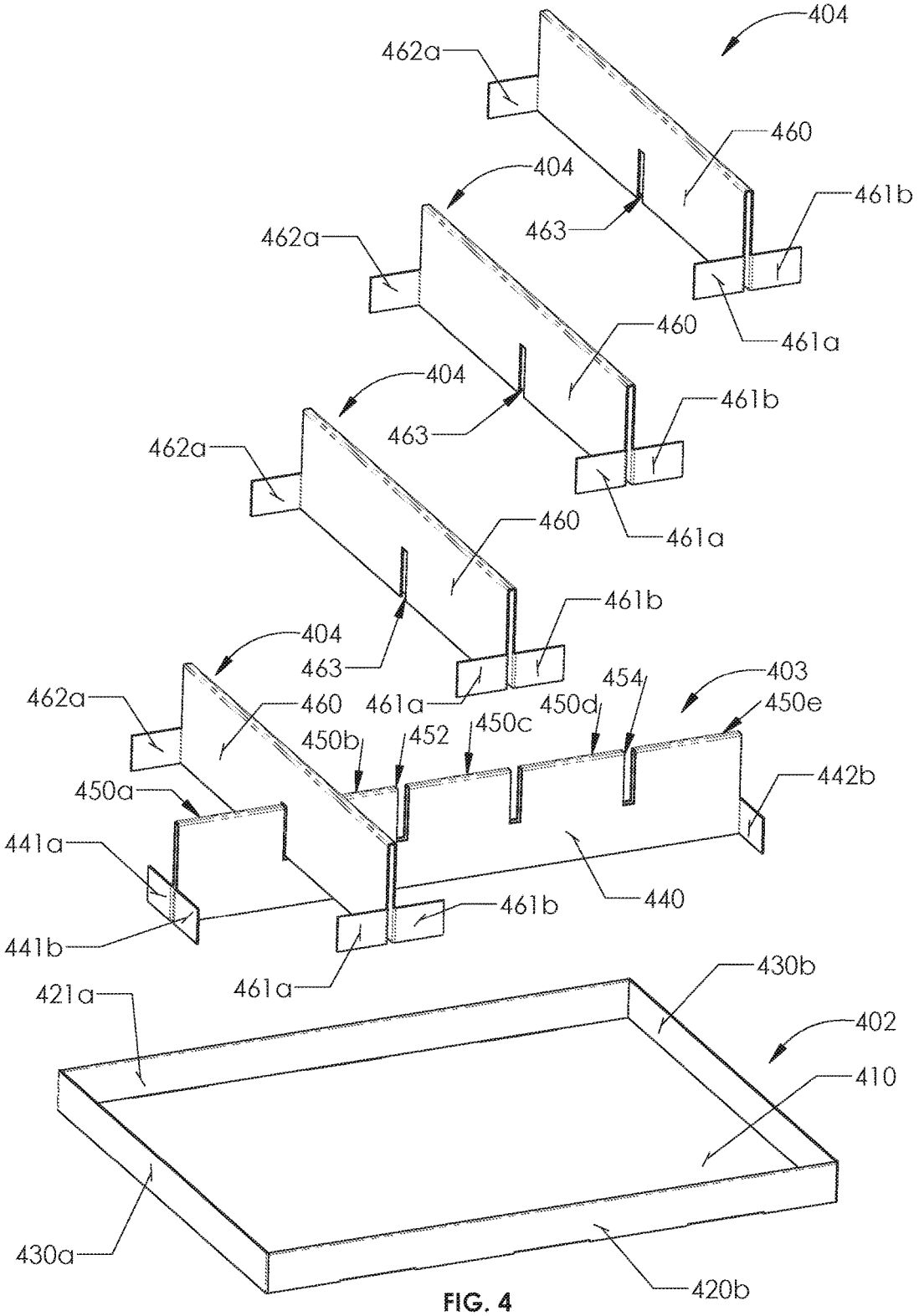
FIG. 4 is an exploded perspective view of an exemplary display tier showing how a base tray, a spine and four cross supports or ribs are assembled according to an embodiment of the present invention.

Referring now to FIG. 4, therein is shown an exploded view of an embodiment of one tier of a portable display container. A base tray 402, comprising (i) a bottom panel 410, (ii) two side panels 420*a*, 420*b*, (iii) two side flaps 421*a*, 421*b*, (iv) two end panels 430*a*, 430*b*, and (v) and two pairs of end panel extensions 431*a*, 432*a* and 431*b*, 432*b* (not shown), forms the bottom of the tier. The two side panels 420*a*, 420*b* are foldably attached to the bottom panel 410 at an angle of approximately 90° relative to the bottom panel 410, and each have a corresponding side flap 421*a*, 421*b* foldably attached at an angle of approximately 180° relative to the corresponding side panel 420*a*, 420*b*, respectively. In the embodiment shown in FIG. 4, the bottom panel has three pairs of bottom slots 411*a*, 411*b* (not shown), 412*a*, 412*b* (not shown), and 413*a*, 413*b* (not shown). The side flaps 421*a*, 421*b* have corresponding tabs 422*a*, 423*a*, 424*a*, and 422*b*, 423*b*, 424*b* respectively. The tabs 422*a*-424*a* are configured to fit into bottom slots 411*a*-413*a*, and the tabs 422*b*-424*b* are configured to fit into bottom slots 411*b*-413*b* (not shown) to lock or otherwise secure the side panels 420*a*, 420*b* and side flaps 421*a*, 421*b* to the bottom panel 410. The number of bottom slots and tabs to secure each side panel/side flap may vary from one slot/tab to 6 slots/tabs or more.

The two opposing end panels 430*a*, 430*b* each have a corresponding pair of end panel extensions 431*a*, 432*a* and 431*b*, 432*b* (not shown). End panel extensions 431*a*, 432*a* are foldably attached to end panel 430*a* at an angle of 90° relative to end panel 430*a*, and end panel extensions 431*b*, 432*b* are foldably attached to end panel 430*b* at an angle of 90° relative to end panel 430*b*. When base tray 410 is completely assembled, end panel extensions 431*a*, 431*b* are captured and/or otherwise secured between side panel 420*a* and side flap 421*a*, and end panel extensions 432*a*, 432*b* are captured or otherwise secured between side panel 420*b* and side flap 421*b*. In some embodiments, end panel extensions 431*a*, 431*b*, 432*a* and 432*b* may comprise glue and/or an adhesive on one or both surfaces of end panel extensions 431*a*, 431*b*, 432*a* and 432*b* to further secure end panel extensions 431*a*, 431*b*, 432*a* and 432*b* to the corresponding side panels 420*a*, 420*b* and/or the side flaps 421*a*, 421*b*.

In the embodiment of FIG. 4, the spine 403 comprises a spine panel 440, having spine top ridges 450*a*-450*e*, a pair of spine extensions 441*a*, 441*b*, 442*a* (not shown), and 442*b*. The pairs of spine extensions 441*a*, 441*b*, 442*a* and 442*b* are configured such that when the spine 403 is placed or otherwise located within bottom tray 402, the spine extensions 441*a*, 441*b* contact and/or engage end panel 430*a*, and the spine extensions 442*a* and 442*b* contact and/or engage end panel 430*b* in order to align and/or stabilize spine 403 within bottom tray 402. In some embodiments, the pairs of spine extensions 441*a*, 441*b* and 442*a*, 442*b* may comprise glue and/or an adhesive on the surfaces in contact with end panels 430*a*, 430*b*, to further secure the pairs of spine extensions 441*a*, 441*b* and 442*a*, 442*b* to their respective end panels 430*a*, 430*b*.

In the embodiment of FIG. 4, spine 403 comprises four spine slots 451-454, each having a height of approximately half (50%) of the height of spine 403 and each configured to receive one of the four cross supports 404 (see below). Although in FIG. 4, there are four spine slots 451-454, spine 403 may have between two and ten slots (e.g., 2, 3, 4, 5, 7, 9, etc.) and an equal number of cross supports 404. In some embodiments, the spine slots 451-454 are evenly spaced across the length of spine 403, while in other embodiments, the distance between cutouts may vary. Most typically, the height of the spine slots 451-454 will be half of the height of the spine 403, but in some embodiments, the height of the spine slots 451-454 may range between 10% and 90% (and all values therein) of the height of the spine 403 (e.g., 10%, 12.5%, 17%, 25%, 38%, 45%, 50%, 62%, etc.).

The four cross supports 404 comprise cross support panel 460 having a cross support top ridge 470, a pair of cross support extensions 461*a*, 461*b* and 462*a*, 462*b* (not shown). Each of the cross supports 404 also comprises a cross support slot 463 having a height of approximately half (50%) of the height of cross support 404 and configured such that when one of the cross supports 404 is inserted into one of the spine slots 451-454 and/or assembled with spine 403, the top of the cross support 404 aligns with the top of spine 403. Most typically, the height of the cross support 404 will be the same as the height of the spine 403, and slot 463 will be half (50%) of the height of the cross support 404. However, in some embodiments, the height of the cross support slot 463 may range between 10% and 90% (and all values therein) of the height of the cross support 404 (e.g., 10%, 12.5%, 17%, 25%, 38%, 45%, 50%, 62%, etc.).

When the height of the spine slots 451-454 are less than 50% of the height of the spine 403, the height of each of the cross support slots 463 will be correspondingly increased so that when one of the cross supports 404 is inserted into and/or assembled with the spine 403, the cross support top ridge 470 aligns with and/or is in the same plane as the spine top ridges 450*a*-450*e*. For example, if the height of the spine slots 451-454 are 35% of the height of the spine 403, the height of each of the cross support slots 463 will be 65% of the height of the cross support 404. Similarly, if the height of the spine slots 451-454 are 22% of the height of the spine 403, the height of each of the cross support slots will be 78% of the height of the cross support 404.

The pairs of cross support extensions 461*a*, 461*b* and 462*a*, 462*b* are configured such that when one of the cross supports 404 is inserted into and/or assembled with the spine 403, and is placed and/or otherwise located within bottom tray 402, one pair of cross support extensions 461*a*, 461*b* contact and/or engage side flap 421*a*, and the other pair of cross support extensions 462*a*, 462*b* contact and/or engage side flap 421*b*. In some embodiments, the pairs of cross support extensions 461*a*, 461*b* and 462*a*, 462*b* may comprise glue and/or an adhesive on the surfaces in contact with side flaps 421*a*, 421*b*, to further secure the pairs of cross support extensions 461*a*, 461*b* and 462*a*, 462*b* to their respective side flaps 421*a*, 421*b*. In embodiments where there are no side flaps, the pairs of cross support extensions may contact, engage and/or be adhered to with glue and/or an adhesive, side panels 420*a*, 420*b*

Exemplary Blanks for Portable Display Containers

Figure 5A:
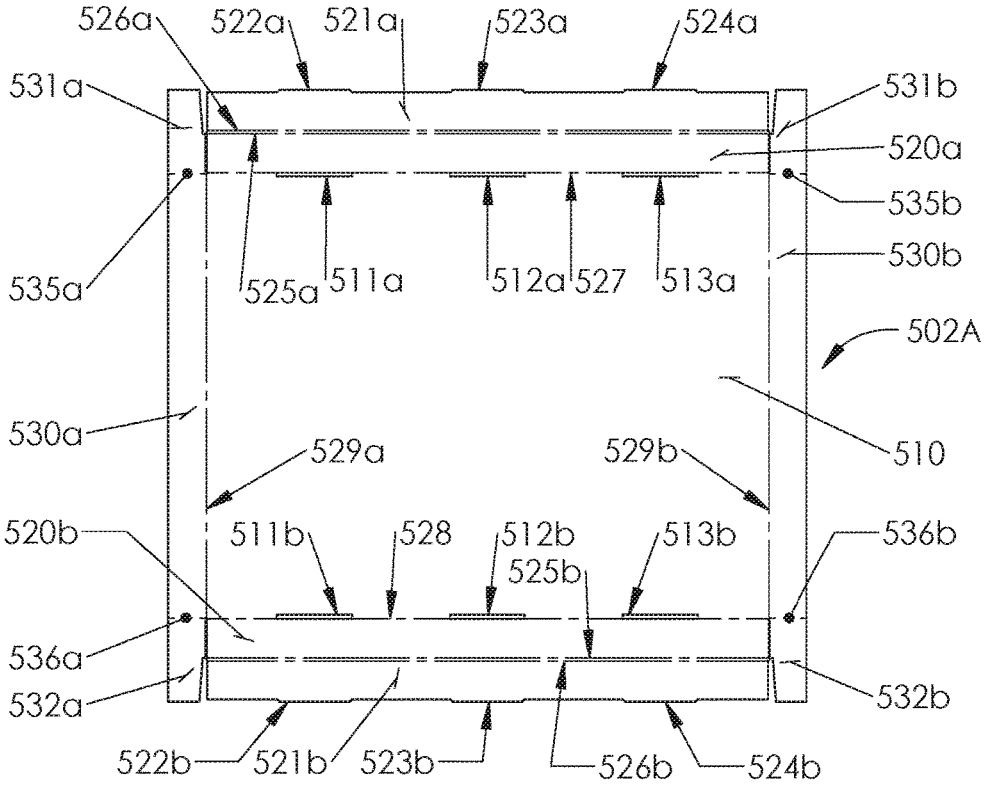
FIG. 5A shows an exemplary blank for the base tray of FIG. 3A having three pairs of bottom slots and corresponding side flap tabs.
Figure 5B:
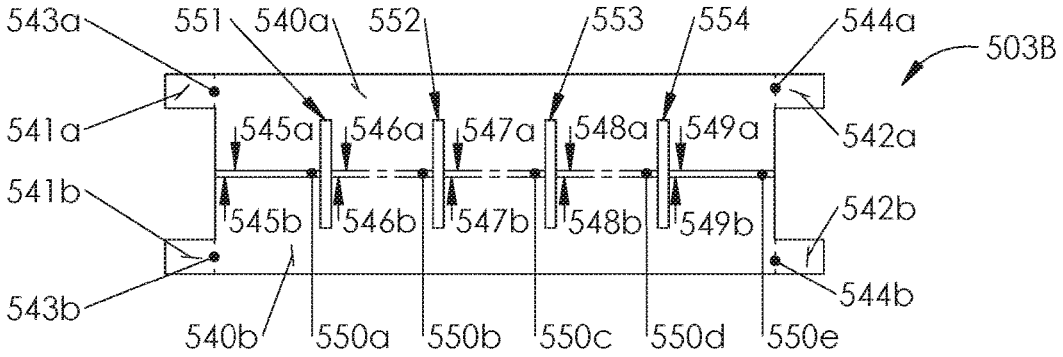
FIG. 5B shows an exemplary blank for the spine of FIG. 3B having four spine cutouts and two pairs of spine extensions.
Figure 5C:
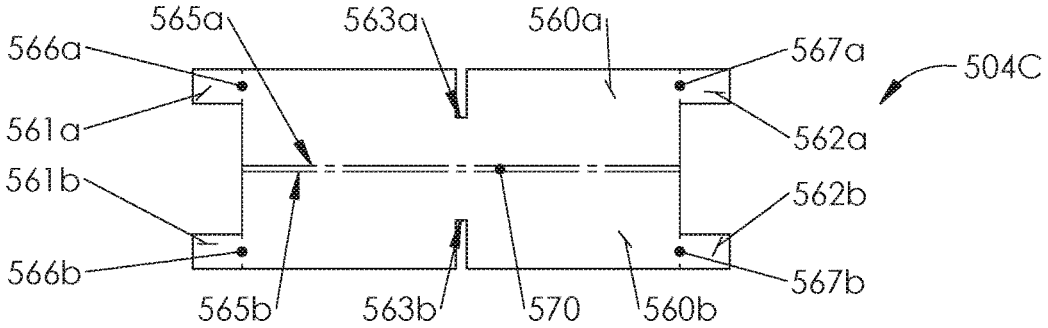
FIG. 5C shows an exemplary blank for the cross support of FIG. 3C having a cross support cutout in each of two cross support flaps and two pairs of cross support extensions.

FIGS. 5A-5C, show exemplary blanks for the base tray, spine and cross supports, respectively, of a portable display container. In some embodiments, the blanks are made from corrugated paper. In other embodiments, the container blanks shown in FIGS. 5A-5C may be made from cardboard, paperboard, a laminate (e.g., paperboard or corrugated paper laminated with plastic and/or foil), combinations thereof, etc.

FIG. 5A shows a blank 502A for a base tray (e.g., the base tray 302 of FIG. 3A). The base tray blank 502A is generally cut from a single sheet of board stock (e.g., corrugated paper or fiberboard, cardboard, etc., which may be single, double or triple ply, laminated or coated with plastic, wax, adhesive paper, etc.) More than one blank may be cut from a single sheet of board stock.

Base tray blank 500A comprises a bottom panel 510, two side panels 520*a*, 520*b*, side flaps 521*a*, 521*b*, and two end panels 530*a*, 530*b*. The opposing end panels 530*a*, 530*b* are foldably attached to the bottom panel 510 at fold lines 529*a*, 529*b*, respectively. The opposing side panels 520*a*, 520*b* are foldably attached to the bottom panel 510 at fold lines 527 and 528 respectively. The side flap 521*a* is foldably attached to the side panel 520*a* at a pair of parallel fold lines 525*a*, 526*a*. Likewise, the side flap 521*b* is foldably attached to side panel 520*b* at a pair of parallel fold lines 525*b*, 526*b*. The pairs of parallel fold lines 525*a*, 526*a* and 525*b*, 526*b* allow for ease of folding the side flap to an angle of approximately 180° in relationship to side panels 520*a*, 520*b*, respectively. In various embodiments, each of the fold lines of a pair 525*a*, 526*a* and 525*b*, 526*b* may be at a distance of between ⅛" and ½" from each other (e.g., ⅛", 3/16", ¼", ⅜", etc.). Fold lines 525*a*, 526*a*, 525*b*, 526*b*, 527, 528, 529*a* and 529*b* may be scored (e.g., pressed and/or partially cut into the material of the blank 500A for ease of folding the container) on one, the other, or both sides of the container blank 500A.

Each of the end panels 530*a*, 530*b* has a pair of end panel extensions 531*a*, 532*a* and 531*b*, 532*b*, respectively, which secure each of the end panels 530*a*, 530*b* to the side panels 520*a*, 520*b* and/or the side flaps 521*a*, 521*b*. End panel extensions 531*a*, 532*a* are foldably attached to end panel 530*a* at fold lines 535*a*, 536*a*, and end panel extensions 531*b*, 532*b* are foldably attached to end panel 530*b* at fold lines 535*b*, 536*b*. Fold lines 535*a*, 536*a*, 535*b*, and 536*b* may be scored on one, the other, or both sides of container blank 500A.

The side flaps 521*a*, 521*b* have tabs 522*a*-524*a* and 522*b*-524*b*, respectively. The bottom panel 510 has bottom slots 511*a*-513*a* and 511*b*-513*b* at and/or near fold lines 527 and 528, respectively, configured to receive tabs 522*a*-524*a* and 522*b*-524*b*. When side panels 520*a*, 520*b* are folded at an angle of approximately 90° relative to bottom panel 510, and when side flaps 521*a*, 521*b* are folded at an angle of approximately 180° relative to side panels 520*a*, 520*b* respectively, tabs 522*a*-524*a* and 522*b*-524*b* align with and/or may be mated with bottom slots 511*a*-513*a* and 511*b*-513*b*, respectively, to secure side panel 520*a*/side flap 521*a* and side panel 520*b*/side flap 521*b* in position relative to the bottom panel 510. Although the base tray blank 502A has three slots 511*a*-513*a* to mate with tabs 522*a*-524*a* to secure side panel 520*a*/side flap 521*a* to bottom panel 510, and likewise three slots 511*b*-513*b* to mate with tabs 522*b*-524*b* to secure side panel 520*b*/side flap 521*b* to bottom panel 510, the number of bottom slots/tabs to secure each side panel/side flap may vary from one slot/tab to 6 slots/tabs or more.

FIG. 5B shows a blank 503B for a spine (e.g., the spine of FIG. 3B). The spine blank 503B is generally cut from a single sheet of board stock (e.g., corrugated paper or fiberboard, cardboard, etc., which may be single, double or triple ply, laminated or coated with plastic, wax, adhesive paper, etc.) More than one blank may be cut from a single sheet of board stock.

The spine blank 503B comprises spine flaps 540*a*, 540*b*, spine center portions 550*a*-550*e*, two pairs of spine extensions 541*a*, 542*a* and 541*b*, 542*b*, and spine cutouts 551-554. The spine flaps 540*a*, 540*b* are foldably attached to the spine center portions 550*a*-550*e* at pairs of parallel fold lines 545*a*/545*b*, 546*a*/546*b*, 547*a*/547*b*, 548*a*/548*b*, and 549*a*/549*b*. The pairs of parallel fold lines 545*a*/545*b*, 546*a*/546*b*, 547*a*/547*b*, 548*a*/548*b*, and 549*a*/549*b* allow for ease of folding each of the spine flaps 540*a*, 550*b* to an angle of approximately 90° in relationship to the spine center portions 550*a*-550*e* to form a spine panel (e.g. the spine panel 340 of FIG. 3B). In various embodiments, each of the fold lines of a pair 545*a*/545*b*, 546*a*/546*b*, 547*a*/547*b*, 548*a*/548*b*, and 549*a*/549*b* may be at a distance of between ⅛" and ½" from each other (e.g., ⅛", 3/16", ¼", ⅜", etc.). Fold lines 545*a*/545*b*, 546*a*/546*b*, 547*a*/547*b*, 548*a*/548*b*, and 549*a*/549*b* may be scored on one, the other, or both sides of the spine blank 503B.

When spine flaps 540*a*, 540*b* are folded at an angle of approximately 90° relative to the spine center portions 550*a*-550*e*, the spine cutouts 551-554 form slots (see, e.g., slots 351-354 of FIG. 3B), and the spine center portions form spine top ridges (see, e.g., spine top ridges 350*a*-350*e* of FIG. 3B). Each of the spine slots formed from the spine cutouts are configured to receive and/or mate with a cross support (e.g., the cross support 304 of FIG. 3C).

In addition, spine flap 540*a* has a pair of spine extensions 541*a*, 542*a* foldably attached to spine flap 540*a* at fold lines 543*a*, 544*a*, respectively. Likewise, spine flap 540*b* has a pair of spine extensions, 541*b*, 542*b* foldably attached to spine flap 540*b* at fold lines 543*b*, 544*b*, respectively. The fold lines 543*a*, 544*a*, 543*b* and 544*b* provide for ease of folding the spine extensions 541*a*, 541*b*, 542*a* and 542*b* to an angle of approximately 90° relative to the corresponding spine flap 540*a* or 540*b*.

Although spine blank 503B comprises four spine cutouts 551-554 and therefore, five spine center portions, in alternative embodiments, spine blank 503B may comprise as few as two spine cutouts (and three spine center portions) or as many as 10 spine cutouts (and 11 spine center portions).

FIG. 5C shows a blank 504C for a cross support (e.g., the cross support of FIG. 3C). The cross support blank 504C is generally cut from a single sheet of board stock (e.g., corrugated paper or fiberboard, cardboard, etc., which may be single, double or triple ply, laminated or coated with plastic, wax, adhesive paper, etc.) More than one blank may be cut from a single sheet of board stock.

The cross support blank comprises cross support flaps 560*a*, 560*b*, cross support center portion 570, two pairs of cross support extensions 561*a*, 562*a* and 561*b*, 562*b*, and cross support cutouts 563*a*, 563*b*. The cross support panels 560*a*, 560*b* are foldably attached to the cross support center portion 570 at parallel fold lines 565*a*, 565*b*. The parallel fold lines 565*a*, 565*b* allow for ease of folding each of the cross support panels to an angle of approximately 90° relative to the cross support center portion to form a cross support panel (e.g., the cross support panel 360 of FIG. 3C) having a cross support top ridge (e.g., the cross support top ridge 370 of FIG. 3C). In various embodiments, the parallel fold lines 565*a*, 565*b*, may be at a distance of between ⅛" and ½" from each other (e.g., ⅛", 3/16", ¼", ⅜", etc.). Parallel fold lines 565*a*, 565*b* may be scored on one, the other, or both sides of the cross support blank 504C.

When cross support flaps 560*a*, 560*b* are each folded at an angle of approximately 90° relative to the cross support center portion 570, the cross support cutouts 563*a*, 563*b* align, essentially forming a single cross support slot (see, e.g., cross support slot 363 of FIG. 3C), and the cross support center portion forms a cross support top ridge (see, e.g., cross support top ridge 370 of FIG. 3C). The single cross support slot formed from the alignment of cross support cutouts 563*a*, 563*b* are configured to be inserted into and/or mate with one of the spine slots (see, e.g., spine slot 351 of FIG. 3B). In some embodiments, each of the cross support flaps 560*a*, 560*b* may have more than one cross support cutouts such that when folded, the assembled cross support panel may have more than one cross support slot. In such embodiments, the cross support is configured to mate with more than one spine, wherein the spines are approximately parallel to each other (see the discussion related to FIG. 2, above).

In addition, cross support flap 560*a* has a pair of cross support extensions 561*a*, 562*a* foldably attached to cross support flap 560*a* at fold lines 566*a*, 567*a*, respectively. Likewise, cross support flap 560*b* has a pair of cross support extensions 561*b*, 562*b* foldably attached to cross support panel 560*b* at fold lines 566*b*, 567*b*, respectively. The fold lines 566*a*, 567*a*, 566*b* and 567*b* allow for ease of folding the cross support extensions 561*a*, 561*b*, 562*a* and 562*b* to an angle of approximately 90° relative to the corresponding cross support flap 560*a* or 560*b*. The fold lines 566*a*, 567*a*, 566*b* and 567*b* may be scored on one, the other, or both sides of the cross support blank 504C.

Figure 6:
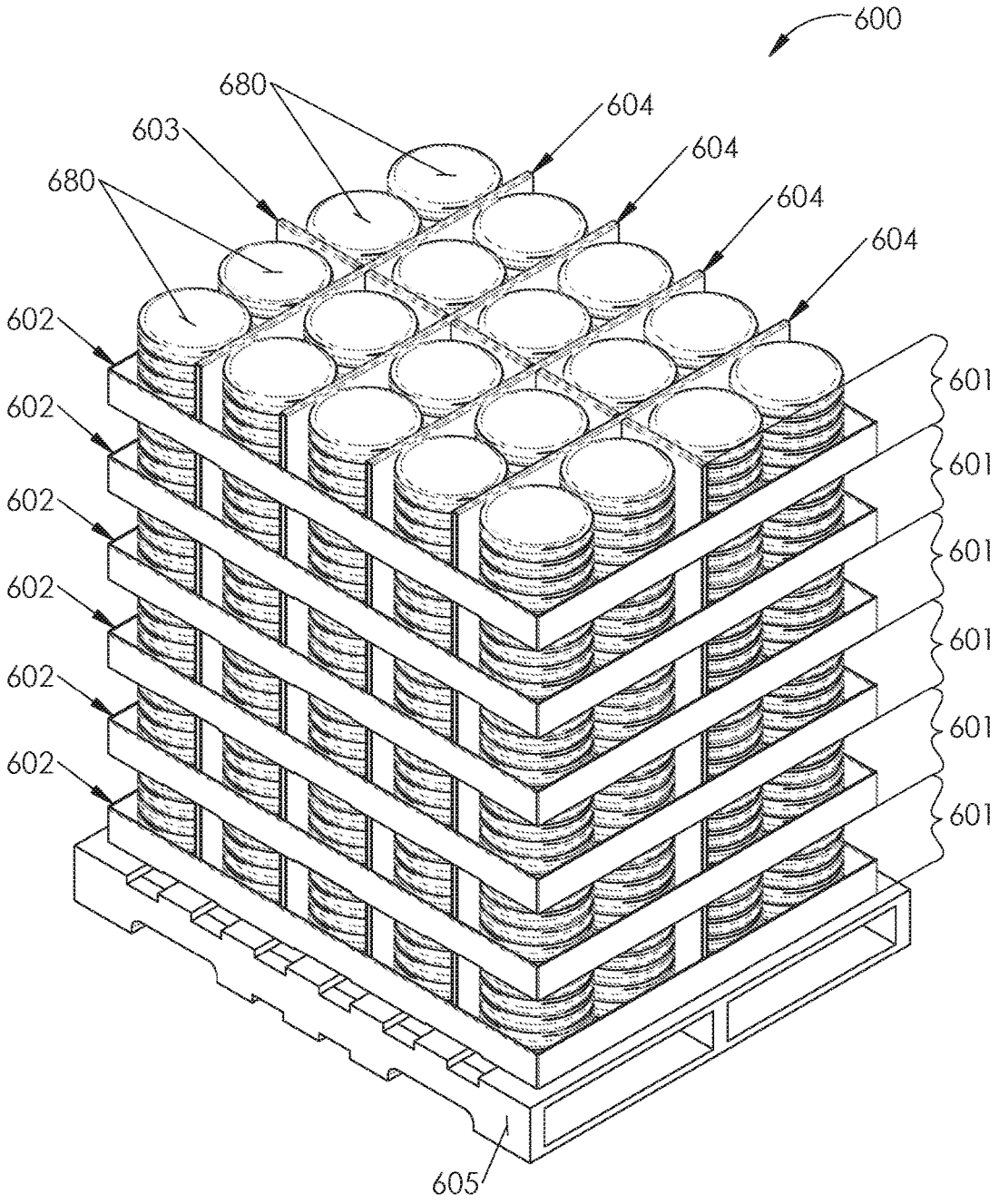
FIG. 6 is a perspective view of an exemplary portable display container loaded with items (i.e., tortilla packages).

Referring now to FIG. 6, therein is shown a portable display container 600 having six display tiers 601, each display tier 601 comprising a base tray 602, one spine 603, four cross supports 604 and a pallet 605. As shown, the portable display container of FIG. 6 also comprises product 680 loaded onto the display tiers. Although the product shown is packages of tortillas, it should be understood that the invention is not so limited and a wide variety of different types of products (e.g., packages of popcorn, chips, nuts, candies, dried fruit, paper products, cotton products, clothing items, etc.) may be loaded onto the display tiers of the portable display container.

Figure 7:
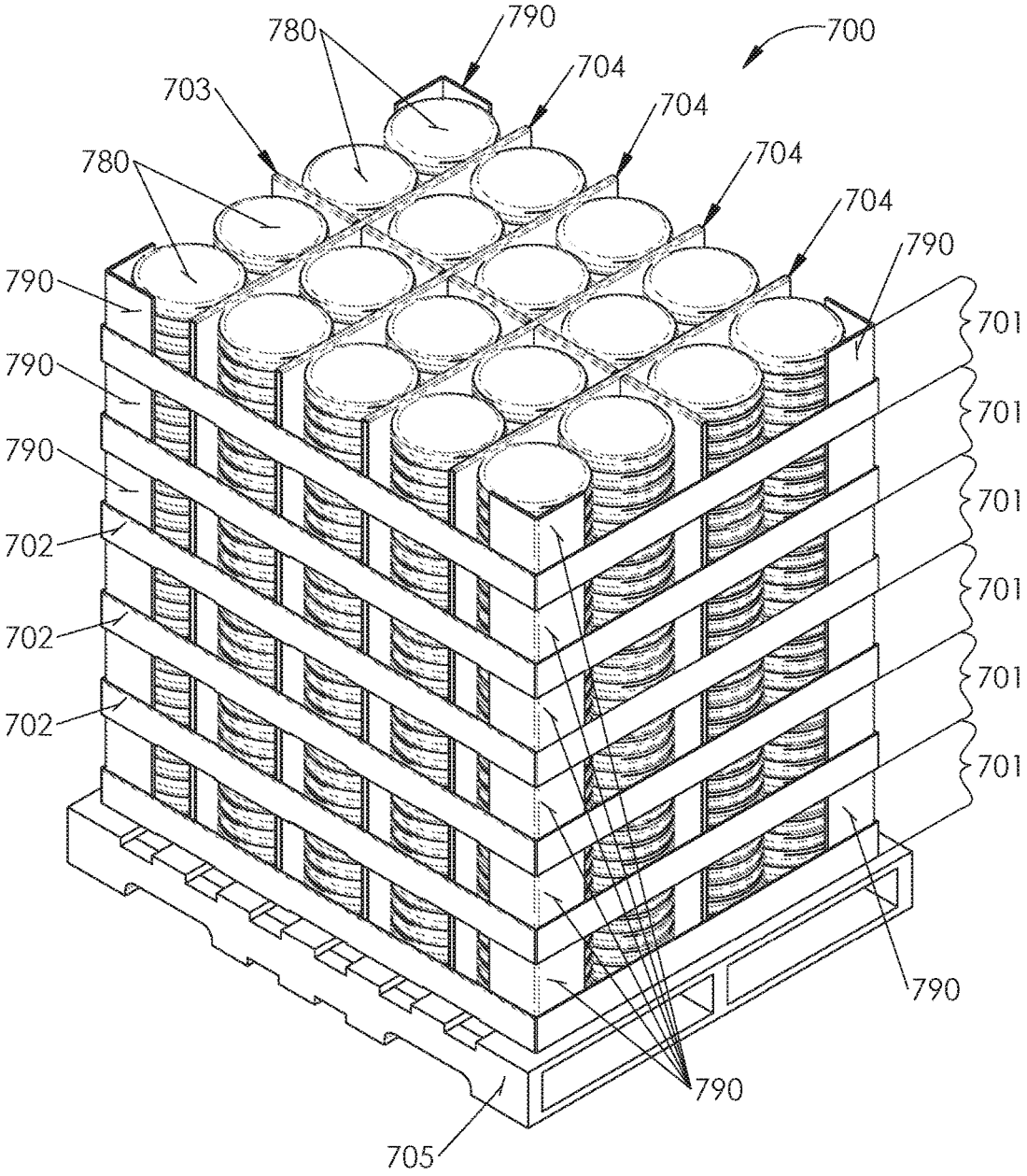
FIG. 7 is a perspective view of an exemplary portable display container having inside corner posts for shipment and/or transportation.

In FIG. 7, there is shown a portable display container 700 having six display tiers 701, each display tier 701 comprising a base tray 702, one spine 703, four cross supports 704, and a pallet 705. As shown, the portable display container of FIG. 7 also comprises product 780 loaded onto the display tiers, and inside corner posts 790. The inside corner posts 790 may be inserted within the corners of each display tier and may extend from at or near the bottom of base tray 702 of one display tier 701 to at or near the bottom of the next display tier 701 in the stack. In some embodiments, the cross section of the inside corner posts 790 may be a 90° angle.

Exemplary Methods of Making Multi-Level Portable Display Containers

An exemplary method of forming multi-level portable display containers generally comprises (a) assembling a display tier by: (i) forming a base tray by (A) folding each of two end panels (e.g., 530*a*, 530*b* of FIG. 5A) along a corresponding fold line (e.g., 529*a*, 529*b* of FIG. 5A) at an angle of approximately 90° relative to a bottom panel (e.g., 510 of FIG. 5A) of a base tray blank (such as blank 502A of FIG. 5A), (B) folding each end panel extension of two pairs of end panel extensions (e.g., 531*a*, 532*a* and 531*b*, 532*b* of FIG. 5A) along corresponding fold lines (e.g., 535*a*-536*a*, 535*b*-536*b* of FIG. 5A) at an angle of approximately 90° relative to the end panel to which the end panel extension is attached, (C) folding each side panel of two side panels (e.g., 520*a*, 520*b* of FIG. 5A) along corresponding fold line (e.g., 527, 528 of FIG. 5A) at an angle of approximately 90° relative to the bottom panel, (D) attaching each of the end panel extension to one of the two side panels; (ii) forming at least one spine by (A) folding each of two spine flaps (e.g. 540*a*, 540*b* of FIG. 5B) along corresponding parallel fold lines (e.g., 545*a*-549*a*/545*b*-549*b* of FIG. 5B) at an angle of approximately 90° relative to spine center portions (e.g. 550*a*-550*e* of FIG. 5B) of a spine blank (e.g., 503B of 5B) to form a spine panel (e.g., 340 of FIG. 3*b*), two or more spine slots (e.g., 351-354 of FIG. 3B) and a spine top ridge (e.g., 350*a*-350*e* of FIG. 3B), and (B) folding two pairs of spine extensions (e.g., 541*a*-542*a*, 541*b*-542*b*) along corresponding fold lines (e.g., 543*a*-544*a*, 543*b*-544*b* of FIG. 5B) at an angle of approximately 90° relative to the spine panel; (iii) placing the at least one spine into the base tray, such that the two pairs of spine extensions contact and/or are attached to the end panels of the base tray; (iv) forming at least two cross supports by (A) folding each cross support flap of two cross support flaps (e.g., 560*a*, 560*b* of FIG. 5C) along corresponding parallel fold lines (e.g., 565*a*, 565*b* of FIG. 5C) at an angle of approximately 90° relative to cross support center portion (e.g., 570 of FIG. 5C) of a cross support blank (e.g., 504C of FIG. 5C) to align cross support cutouts (e.g., 563*a*, 563*b* of FIG. 5C) and form a cross support panel (e.g., 360 of FIG. 3*c*) and a cross support top ridge (e.g., 570 of FIG. 3C), and (B) folding each cross support extension of two pairs of cross support extensions (e.g., 561*a*-562*a* and 561*b*-562*b* of FIG. 5C) along corresponding fold lines (e.g., 566*a*-567*a* and 566*b*, 567*b* of FIG. 5C) at an angle of approximately 90° relative to the cross support panel; (v) inserting into and/or mating the cross support slot of each of the cross supports with one of the spine slots of the spine(s) such that the spine top ridge and the cross support top ridge are in the same plane and such that the cross support extensions contact the corresponding side panels of the base tray; (b) placing the display tier on a portable platform or on another tier of the stack of display tiers; and (c) repeating steps (a) and (b) for each tier of the portable display container.

The method may also comprise folding each of two side flaps (e.g., 521*a*, 521*b* of FIG. 5A) along two parallel fold lines (e.g., 525*a*-526*a* and 525*b*-526*b* of FIG. 5A) at an angle of approximately 180° relative to one to the side panel to which the side panel is attached, and placing and/or inserting each end panel extension of the two pairs of end panel extensions in between the side panel and side flap. The method may further comprise inserting each of one or more tabs (e.g., 522*a*-524*a*, 522*b*-524*b* of FIG. 5A) into each of one or more bottom slots (e.g., 511*a*-513*a*, 511*b*-513*b* of FIG. 5A) to secure the side flaps to the bottom panel, and the end panel extensions between the side panels and the side flaps.

In some embodiments, steps of the method may be performed in a different order while still providing for a complete assembly. For example, the step of inserting into and/or mating the cross support slot of each of the cross supports with one of the spine slots of the spine(s) may be performed prior to the step of placing the at least one spine into the base tray. Similarly, the step of folding each end panel extension of two pairs of end panel extensions along corresponding fold lines at an angle of approximately 90° relative to the end panel to which the end panel extension is attached may be performed prior to the step of folding each of two end panels along a corresponding fold line at an angle of approximately 90° relative to a bottom panel of a base tray blank. It should be understood that where practical, the present invention includes performing the steps in a different order other than that order specifically described above.

In some embodiments the method may comprise, for each spine, applying adhesive to the two pairs of spine extensions prior to placing the spine(s) into the base tray and/or for each cross brace, applying an adhesive to the two pairs of cross brace extensions prior to inserting into and/or mating the cross braces with the spine(s).

The display tiers may comprise single, double and/or triple wall corrugated pads. In other embodiments, the display tiers may be made from cardboard, paperboard, chipboard, a honeycomb pad, a laminate (e.g., paperboard or corrugated paper laminated with plastic and/or foil), combinations thereof, etc.

Exemplary Methods of Using Portable Display Containers

An exemplary method of using portable display containers generally comprises: (a) placing a plurality of items in the portable display container described above, (b) placing inside corner posts within the corners of each display tier, wherein the cross section of each of the inside corner posts is a 90° angle and each of the inside corner posts extend from at or near the bottom panel of one base tray of one display tier to at or near the bottom panel of the next display tier above in the stack; (c) wrapping the portable display container with protective material; (d) moving and/or transporting the portable display container to a display location; and (e) removing the protective material.

The method may also include removing the inside corner posts after the portable display container is moved and/or transported to the display location. In some embodiments the method may further comprise placing outside corner posts at the corners of the portable display container, wherein the outside corner posts extend from at or near the portable platform to the top of the top display tier of the stack, and removing the corner posts after the portable display container is moved and/or transported to the display location.

The inside corner posts and outside corner posts may comprise from cardboard (including compressed cardboard), paperboard, chipboard, a honeycomb pad, a laminate (e.g., paperboard or corrugated paper laminated with plastic and/or foil), combinations thereof, etc.

CONCLUSION

Thus, the present invention advantageously provides portable display containers that are effective for product display because of the openness and the ease of access to the product in the containers, yet are strong and rigid enough to protect the product during shipment and/or transportation to the display location, thereby eliminating the need for additional handling to load the product into the display container after the product arrives at the display destination. The portable display containers described herein are also cost effective and environmentally-friendly because they are recyclable after use. The present invention also advantageously provides methods of making and using portable display containers.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method of using a portable display container comprising:

a) placing a plurality of items in the portable display container, the display container comprising:

i) a plurality of display tiers in a stack, each display tier comprising:

a base tray comprising (A) a bottom panel, (B) two side panels, each of the side panels attached to the bottom panel at an angle of about 90° relative to the bottom panel, and (C) two end panels, each of the end panels attached to the bottom panel at an angle of about 90° relative to the bottom panel;

at least one spine, each spine comprising two spine flaps, each spine flap attached to a spine ridge at an angle of about 90° relative to the spine ridge and having at least two spine slots, wherein the two spine flaps and the spine ridge remain rigid when the display tier is loaded with product and stacked;

two or more cross supports, each cross support comprising (A) two cross support flaps attached to a cross support ridge at an angle of about 90° relative to the cross support ridge and having at least one cross support slot configured such that the at least one cross support slot mates with the at least one spine at one of the spine slots, wherein the two cross support flaps and the cross support ridge remain rigid when the display tier is loaded with product and stacked;

ii) a portable platform, wherein the base tray of each display tier rests on or is in contact with the portable platform or another display tier of the stack;

b) wrapping the portable display container with protective material;

c) moving or transporting the portable display container to a display location; and d) removing the protective material.

2. The method of claim 1, further comprising placing inside corner posts within the corners of each display tier, wherein the cross section of each of the inside corner posts is a 90° angle and each of the inside corner posts extend from at or near the bottom panel of one base tray of one display tier to at or near the bottom panel of the next display tier above in the stack.

3. The method of claim 2, wherein the inside corner posts comprise cardboard.

4. The method of claim 2, further comprising removing the inside corner posts after the portable display container is moved and/or transported to the display location.

5. The method of claim 1, further comprising placing outside corner posts at the corners of the portable display container, wherein the outside corner posts extend from at or near the portable platform to the top of the top display tier of the stack.

6. The method of claim 5, further comprising removing the outside corner posts after the portable display container is moved and/or transported to the display location.

7. The method of claim 5, wherein the outside corner posts comprise cardboard.

8. The method of claim 1, wherein the protective material is plastic shrink wrap.

9. A method of using a portable display container comprising:

a) placing a plurality of items in the portable display container, the display container comprising:

i) a plurality of display tiers in a stack, each display tier comprising:

a base tray comprising (A) a bottom panel, (B) two side panels, each of the side panels attached to the bottom panel at an angle of about 90° relative to the bottom panel, and (C) two end panels, each of the end panels attached to the bottom panel at an angle of about 90° relative to the bottom panel;

at least one spine, each spine comprising two spine flaps, each spine flap attached to a spine ridge at an angle of about 90° relative to the spine ridge and having at least two spine slots, wherein the two spine flaps and the spine ridge remain rigid when the display tier is loaded with product and stacked;

two or more cross supports, each cross support comprising two cross support flaps attached to a cross support ridge at an angle of about 90° relative to the cross support ridge and having at least one cross support slot configured such that the at least one cross support slot mates with the at least one spine at one of the spine slots, wherein the two cross support flaps and the cross support ridge remain rigid when the display tier is loaded with product and stacked;

ii) a portable platform, wherein the base tray of each display tier rests on or is in contact with the portable platform or another display tier of the stack;

b) placing inside corner posts within the corners of each display tier, wherein each of the inside corner posts extend from near the bottom of one base tray of the display tier to at or near the bottom panel of the next display tier above in the stack;

c) wrapping the portable display container with protective material;

d) moving or transporting the portable display container to a display location; and e) removing the protective material.

10. The method of claim 9, further comprising removing the inside corner posts after the portable display container is moved and/or transported to the display location.

11. The method of claim 10, wherein the insider corner posts comprise cardboard.

12. The method of claim 9, further comprising placing outside corner posts at the corners of the portable display container, wherein the outside corner posts extend from at or near the portable platform to the top of the top display tier of the stack.

13. The method of claim 12, wherein method further comprises removing the outside corner posts after the portable display container is moved or transported to the display location.

14. The method of claim 12, wherein the cross section of each of the outside corner posts is a 90° angle.

15. The method of claim 9, wherein the portable platform is a pallet.

16. The method of claim 9, wherein the display tiers are cardboard.

17. A method of forming a portable display container with a plurality of tiers in a stack, comprising, a) assembling a display tier by:

i) forming a base tray by (A) folding each of two end panels at an angle of approximately 90° with respect to a bottom panel of a blank for a base tray, (B) folding each side panel of two opposing side panels at an angle of approximately 90° relative to the bottom panel; and (C) attaching each of the end panels to one of the two side panels;

ii) forming at least one spine by folding each of two spine flaps at an angle of about 90° relative to spine center portions of a spine blank to form a spine panel, two or more spine slots and a spine top ridge;

iii) placing the at least one spine into the base tray such that the spine contacts and/or is attached to the end panels of the base tray;

iv) forming at least two cross supports by folding each cross support flap of two cross support flaps at an angle of approximately 90° relative to a cross support center portion of a cross support blank to align cross support cutouts and form a cross support panel with at least one cross support slot and a cross support top ridge;

v) inserting into and/or mating each of the cross supports with one of the spine slots of the spine(s) such that the spine top ridge and the cross support top ridge are in the same plane and such that the cross support contact the corresponding side panels of the base tray;

b) placing the display tier on a portable platform or on another tier of the stack of display tiers; and c) repeating steps a) and b) for each tier of the portable display container.

18. The method of claim 17, further comprising (A) folding each end panel extension of two pairs of end panel extensions at an angle of about 90° with respect to the end panel to which the end panel extension is attached; and (B) folding each side flap of two opposing side flaps at an angle of about 180° with respect to the side panel to which the side flap is attached, and placing and/or inserting each end panel extension of the two pairs of end panel extensions in between the side panel and the side flap.

19. The method of claim 17, further comprising, folding each spine extension of two pairs of spine extensions at an angle of approximately 90° relative to the spine panel such that the spine extensions contact and/or are attached to the corresponding end panels of the base tray.

20. The method of claim 17, further comprising, folding each cross support extension of two pairs of cross support extensions at an angle of approximately 90° relative to the cross support panel such that the cross support extensions contact the corresponding side panels of the base tray.

* * * * *